US006729841B2

(12) United States Patent
Kusagaya et al.

(10) Patent No.: US 6,729,841 B2
(45) Date of Patent: May 4, 2004

(54) TURBINE PUMP

(75) Inventors: Katsuhiko Kusagaya, Kariya (JP); Motoya Ito, Hekinan (JP); Yukio Mori, Nagoya (JP)

(73) Assignee: Denso Corporation (JP)

( * ) Notice: Subject to any disclaimer, the term of this patent is extended or adjusted under 35 U.S.C. 154(b) by 51 days.

(21) Appl. No.: 10/107,209

(22) Filed: Mar. 28, 2002

(65) Prior Publication Data

US 2002/0141860 A1 Oct. 3, 2002

(30) Foreign Application Priority Data

Mar. 29, 2001 (JP) ..... 2001-097181
Feb. 5, 2002 (JP) ..... 2002-027949

(51) Int. Cl.[7] ..... F04D 5/00

(52) U.S. Cl. ..... 415/55.1; 415/55.2; 415/55.5; 415/55.6

(58) Field of Search ..... 415/55.1, 55.2, 415/55.3, 55.4, 55.5, 55.6, 55.7

(56) References Cited

U.S. PATENT DOCUMENTS 5,017,086 A * 5/1991 Hansen ..... 415/55.5
5,310,308 A * 5/1994 Yu et al. ..... 415/55.6
5,468,119 A 11/1995 Huebel et al.
5,702,229 A * 12/1997 Moss et al. ..... 415/55.4
5,961,276 A * 10/1999 Huebel et al. ..... 415/55.1
6,174,128 B1 * 1/2001 Yu ..... 415/55.2
6,464,450 B1 * 10/2002 Fischer ..... 415/55.1

FOREIGN PATENT DOCUMENTS

| | | |
|---|---|---|
| JP | 8-277793 | 10/1996 |
| JP | 9-79168 | 3/1997 |
| JP | 9-79170 | 3/1997 |

* cited by examiner

*Primary Examiner*—Edward K. Look
*Assistant Examiner*—Igor Kershteyn
(74) *Attorney, Agent, or Firm*—Nixon & Vanderhye PC

(57) ABSTRACT

A turbine pump includes a casing having an inlet, an outlet and front and rear arc-shaped pump passages and an impeller. The impeller has plural impeller partitions respectively disposed between every two of the blades thereby forming impeller grooves at front and rear sides of the partitions and an outer ring at the peripheral edge of the blades. Each impeller groove, each of pump passage and the outer ring form a space for circulating fuel. The outside diameter of the impeller is smaller than the pump passages so that the impeller does not contact the pump passages.

6 Claims, 5 Drawing Sheets

TURBINE PUMP

CROSS REFERENCE TO RELATED APPLICATION

The present application is based on and claims priority from Japanese Patent Applications 2001-97181, filed Mar. 29, 2001 and 2002-27949, filed Feb. 5, 2002, the contents of which are incorporated herein by reference.

BACKGROUND OF THE INVENTION

1. Field of the Invention

The present invention relates to a turbine pump that is suitable to a fuel pump to be mounted in a fuel tank of an automotive vehicle.

2. Description of the Related Art

U.S. Pat. No. 5,468,119 or its corresponding publication JP-A-299983 discloses a turbine pump or peripheral pump for a fuel pump to be mounted in an automotive vehicle. The disclosed turbine pump has an outer ring at the circumference of an impeller, which is disposed in chamber walls or a pump casing. The outer ring is disposed outside the spaces (hereinafter referred to the impeller grooves) between blades of the impeller in the radial direction. The outer ring, which is disposed around the impeller grooves, has axial end surfaces flush with the axial end surfaces of the blades. The outside diameter of the impeller is larger than the outside diameter of a pump passage that is formed in the casing and the outer ring is located close to the axial end surface of the pump casing.

In such a turbine pump, the axial distance between the impeller and the casing is arranged to be between several micrometers ($\mu$m) and tens of micrometers to prevent high-pressure fuel from leaking from the outlet side of the pump to the inlet side thereof.

While the turbine pump is operating, the impeller moves in the axial direction due to the reaction of the pumping operation. Accordingly, the axial end surface of the outer ring of the impeller contacts the peripheral end surface of the casing.

Because the outer ring is located at the outermost portion of the impeller, the circumferential speed is so high that the outer ring is subject to wear, which lowers pumping capacity and the lifetime thereof.

SUMMARY OF THE INVENTION

Therefore, the present invention has been made in view of the above problems.

It is a main object of the invention to provide a reliable turbine pump which prevents the outer ring from wearing.

According to a main feature of the invention, an impeller of a turbine pump has a plurality of blades disposed in the circumferential direction thereof, a plurality of impeller partitions respectively disposed between every two of the blades thereby forming a plurality of impeller grooves at front and rear sides of the partitions and an outer ring disposed at the peripheral edge of the blades. Each impeller groove, each pump passage and the outer ring form a circular space for circulating fuel thereby pressuring and discharging the fuel. The outside diameter of the impeller is smaller than the outside diameter of the pump passages. Therefore, the peripheral portion of the impeller is disposed within the pump passages where the impeller does not contact any surface of the pump passages. It is more preferable that the axial ends of the outer ring are positioned within axial ends of the blades. In addition, the outer ring may have axial ends that are tapered off in the radially inward direction.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

A turbine pump according to a first embodiment of the invention to be mounted in a fuel tank for an engine (not shown) is described with reference to FIGS. 1–4.

Figure 1:
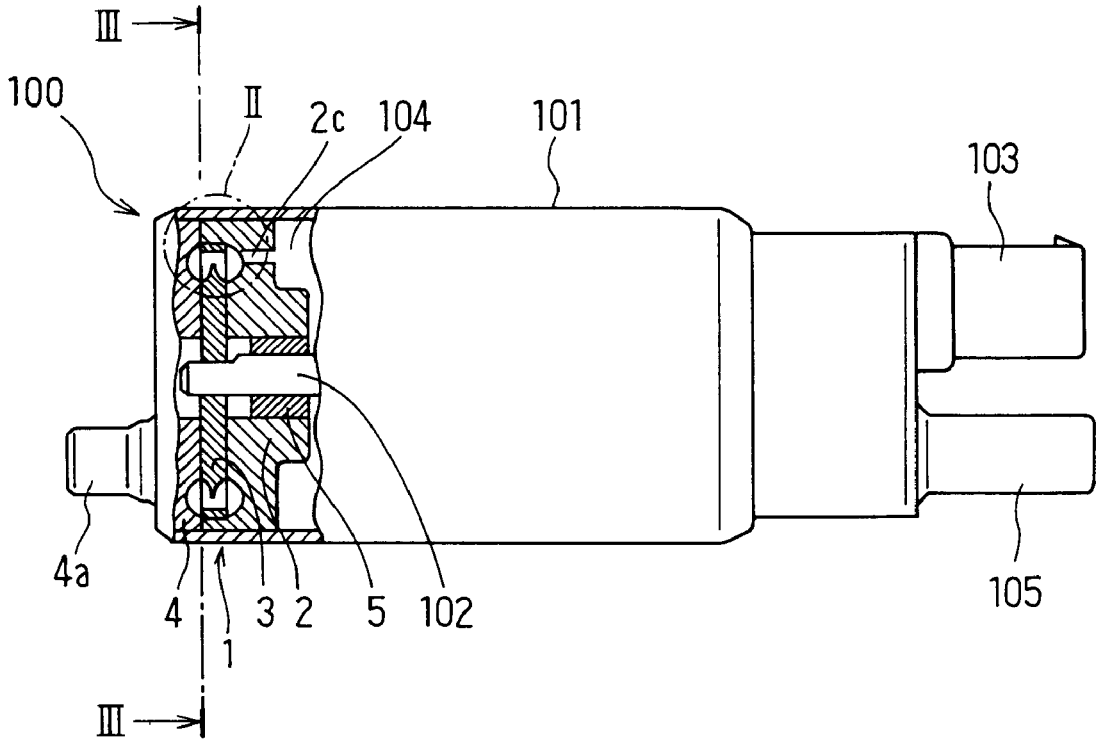
FIG. 1 is a partially cross-sectional side view of a turbine pump according to a first embodiment of the invention.

As shown in FIG. 1, a turbine pump 1 according to a first embodiment of the invention is mounted in a fuel pump 100 together with a drive motor (not shown), which are covered by a housing 101. The fuel pump includes, besides the drive motor, a motor shaft 102, an electric connector 103, a fuel chamber 104, a fuel discharge pipe 105 and a fuel intake pipe 4*a*. When electric power is supplied to the fuel pump 100 via the connector 103, the turbine pump 1 pumps up fuel in a fuel tank from an intake pipe 4*a* and discharges the fuel from the turbine pump into the fuel chamber 104. Thereafter, the fuel is supplied to an engine via the fuel discharge pipe 105. The fuel chamber 104 is provided inside the drive motor.

The turbine pump 1 is comprised of a pump casing 2, an impeller 3, and a pump cover 4. The impeller 3 is rotatably disposed between the pump casing 2 and the pump cover 4.

Figure 2:
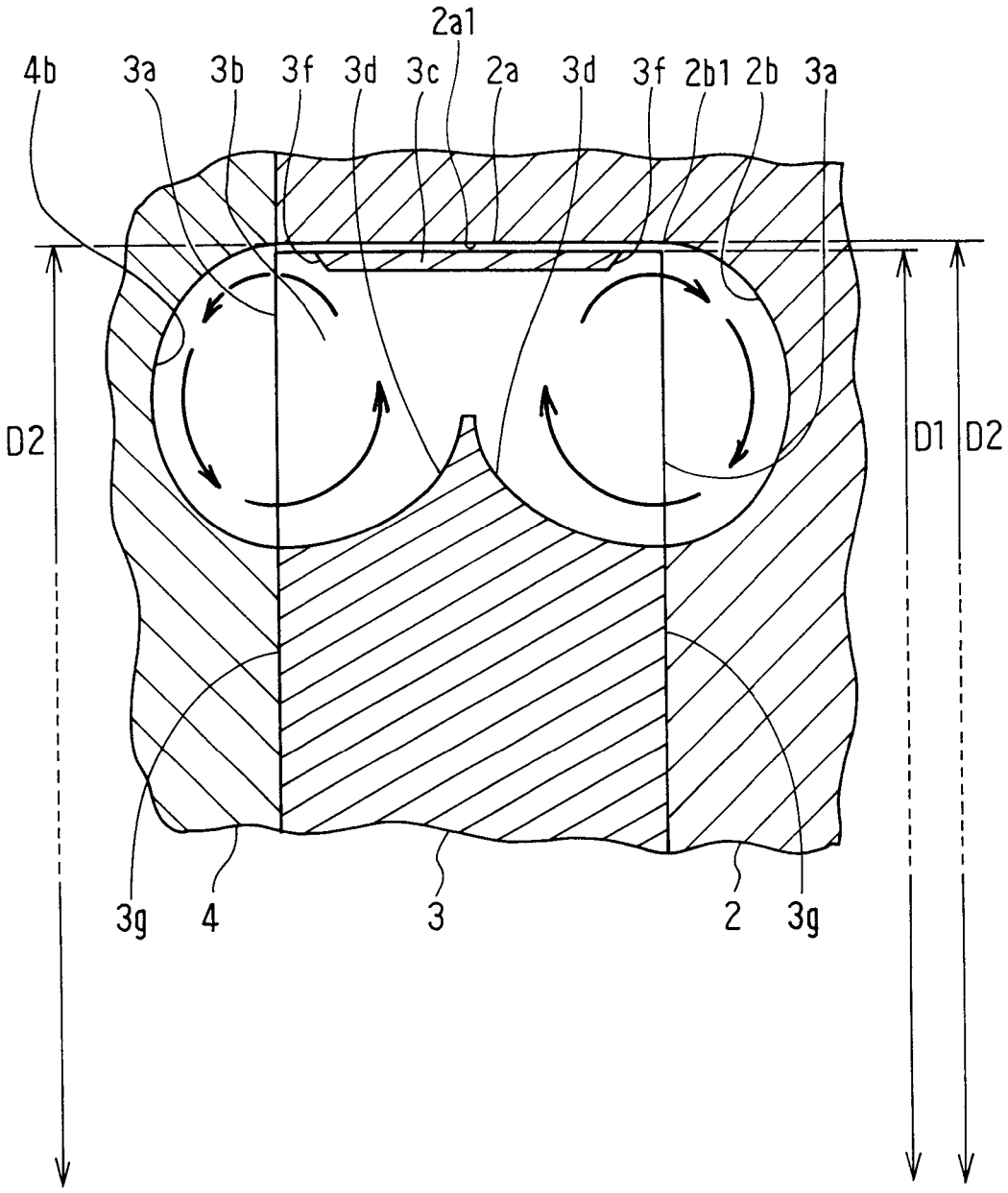
FIG. 2 is a fragmentary enlarged cross-sectional side view of a portion of the turbine pump shown in FIG. 1 encircled by circle II.
Figure 3:
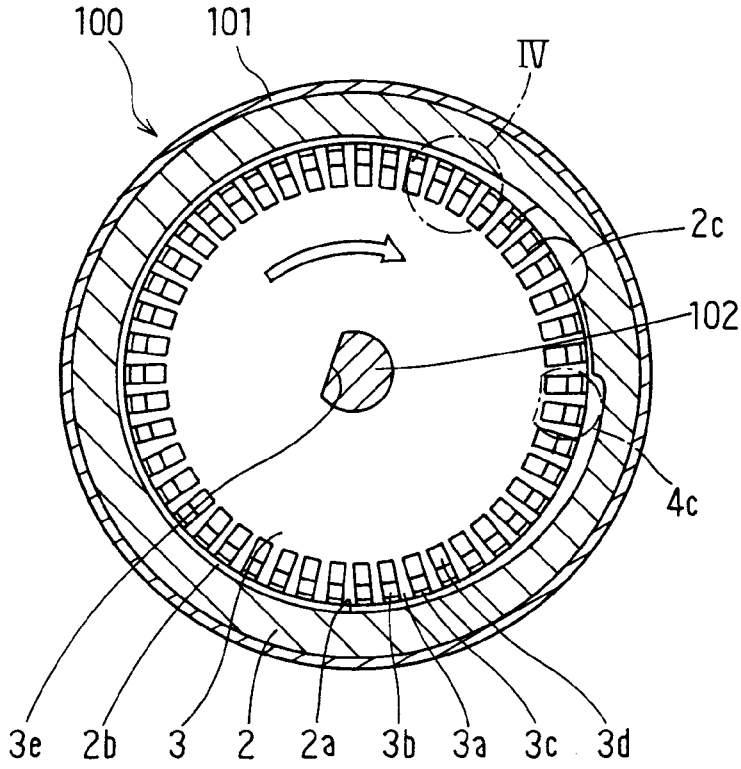
FIG. 3 is cross sectional view of a portion of the turbine pump shown in FIG. 1 cut along line III—III.
Figure 4:
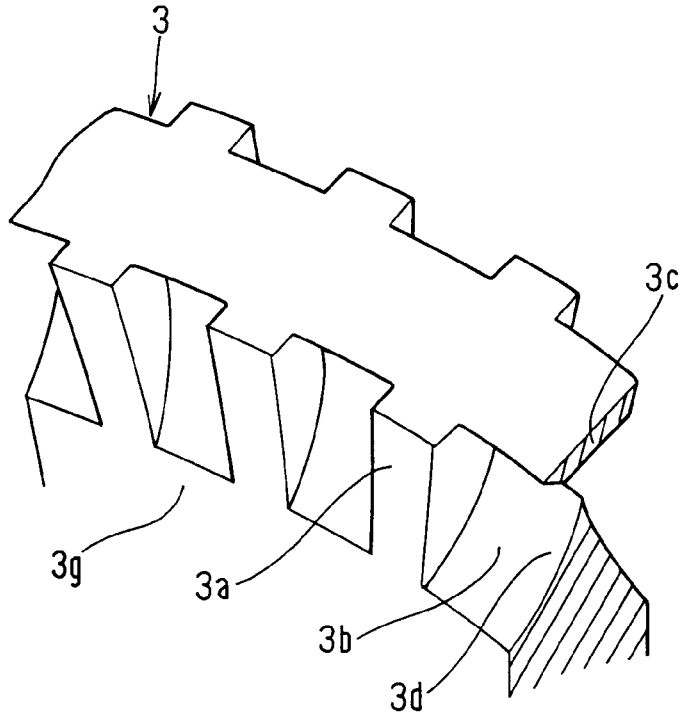
FIG. 4 is a fragmentary enlarged perspective view of a portion of the turbine pump shown in FIG. 3 encircled by circle IV.

The pump casing 2 is made of aluminum die-cast or strong resinous material that is resistant to fuel and has a cylindrical space 2*a* that accommodates the impeller 3. The axial depth of cylindrical space 2*a* is a distance between several micrometers ($\mu$m) and tens of micrometers longer than the thickness of the impeller 3. In other words, the gap between the pump cover 4 and the impeller is the same as the gap between the pump casing 2 and the impeller 3. As shown in FIGS. 2 and 3, a pump passage 2*b* is formed to be coaxial with the cylindrical space 2*a*. The pump passage 2*b* is connected to the inlet 4*c* at an end thereof and connected to the outlet 2*c* at the other end thereof. In the meantime, the inlet 4*c* is indicated in FIG. 3 by one-dot-chain line for reference. As shown in FIG. 2, radially outermost surface 2*bl* of the pump passage 2*bl* is included in the inner surface 2*al* of the cylindrical space 2*a*. In other words, the outside diameter of the pump passage 2*b* is the same as the inside diameter D2 of the cylindrical space 2*a*. A plurality of blades 3*a* is formed at the axial end surface 3*g* of the impeller 3. The radial distance between the outside diameter D1 of the impeller 3 and the inside diameter D2 of the cylindrical space 2*a* is designed to be the best for pump performance. That is, the outside diameter D1 of the impeller 3 is designed to be smaller than the outside diameter of the pump passage 2*b*. Accordingly, the portion of the impeller 3 whose circumferential speed is the maximum while the impeller rotates does not contact the surface of the pump passage 2*b* or any other portion of the pump casing 2. The pump casing 2 has a bearing 5 that rotatably supports a motor shaft 102 at the center thereof.

The impeller 3 is made of heat resistant resinous material and is disposed in the cylindrical space 2*a* of the pump casing 2. As shown in FIG. 3, the impeller 3 has a plurality of blades 3*a* formed at both the peripheral front surface that faces the pump casing 2 and the peripheral rear surface that faces the pump cover 4. The blades 3*a* formed at the front surface and the blades formed at the rear surface are disposed side by side at equal intervals in the circumferential direction. An impeller groove 3*b* is formed between each adjacent two blades 3*a*. As shown in FIG. 2, impeller partitions 3*d* are disposed at an axially middle and radially inside portion thereof to protrude radially outward to divide each of the impeller grooves 3*b* into a front side groove and a rear side groove. Thus, the fuel introduced in the space (hereinafter referred to as the circular space) defined by the impeller grooves 3*b*, the pump passage 2*b* of the pump casing 2 and a pump passage 4*b* of the pump cover 4 is circulated and pressured by the impeller 3. An outer ring 3*c* is integrated with the plurality of blades 3*a* to connect the same at the edges thereof. In other words, the outer ring 3*c* closes the circumference of the impeller 3. The axial ends of the outer ring 3*c* are positioned within the axial ends of the impeller 3. The outer ring 3*c* has a trapezoidal cross section with the shorter side being radially inward, as shown in FIG. 2. That is, the axial length of a portion of the outer ring 3*c* becomes longer as it shifts radially outward. In other words, the outer ring 3*c* has axial end surfaces 3*f* that taper off in the radially inward direction.

While the turbine pump is operating, fuel circulates in the circular spaces defined by the impeller grooves 3*b* and the pump passages 2*b* and 4*b* as indicated by arrows in FIG. 2. The above arrangement of the outer ring 3*c* is effective to smooth circulation of the fuel.

The impeller 3 has a semicircular center hole 3*e*, to which the motor shaft 102 is fitted to rotate the impeller 3.

The pump cover 4 is also made of aluminum die-cast or strong resinous material that is resistant to fuel. The pump passage 4*b* is formed at the portion of the pump cover 4 opposite the pump passage 2*b* to enclose the blades 3*a* of the impeller 3. In other words, the outside diameter D1 of the impeller 3 or the outer ring 3*c* is smaller than the outside diameter D2 of the pump passage 4*b*. Therefore, the outer ring 3*c*, whose circumference speed is larger than other portions of the impeller 3, is disposed within the pump passage 4*b* and do not contact the surface of the pump passage 4*b* or other surface of the pump cover 4 while the impeller 3 is rotating. Accordingly, the impeller 3 is not subject to wear. On the other hand, the axial end of the blades 3*a* contact the surfaces of the casing 2 and the pump cover 4 opposite the blades 3*a* to seal the portion between the outlet 2*c* and the inlet 4*c*. The inlet 4*c* is formed in the pump cover 4 to connect the pump passages 2*b* and 4*b*.

The fuel pump 100 is assembled in the following manner.

A drive motor, a motor drive unit and the connector 103 are assembled into the housing 101 and electrically connected at first. Next, the turbine pump 1 is inserted into the housing 101. Then, the pump casing 2 is force-fitted to the housing 101, and the motor shaft 102 is fitted to the bearing 5 as shown in FIG. 1. Thereafter, the impeller 3 is inserted into the cylindrical space 2*a* of the pump casing 2, and the motor shaft 102 is inserted into the center hole 3*e*. Next, the pump cover 3 is positioned relative to the pump casing 2 and force-fitted into the housing 101. Finally, the edge portion of the housing 101 is clamped to fix the turbine pump 1.

When the impeller 3 is rotated by the motor in the direction indicated by an arrow in FIG. 3, fuel is pumped up from the intake pipe 4*a* and introduced into the circular space via the inlet 4*c*. The fuel in the impeller grooves 3*b* is circulated in the circular space defined by the impeller grooves 3*b* and the pump passages 2*b* and 4*b*. In other words, the fuel is moved radially outward by centrifugal force due to the rotation, turned by the outer ring 3*c* and introduced into the pump passage 2*b*, as indicated by arrows in FIG. 2. The fuel is further guided by the inner surface of the pump passage 2*b*, moved in the rotation direction of the impeller 3 and introduced into the impeller grooves 2*b*. Thereafter, the fuel is moved radially outward again by the centrifugal force, turned by the outer ring 3*c* and introduced into the pump passage 2*b*. Thus, the fuel is repeatedly moved and circulated to increase the pressure thereof before it is discharged from the fuel outlet 2*c*. The fuel in the pump passage 4*b* is moved and circulated in the same manner as described above and shown in FIG. 2, so that two symmetrical pressuring motions of the fuel are set up in the turbine pump 1.

Figure 5:
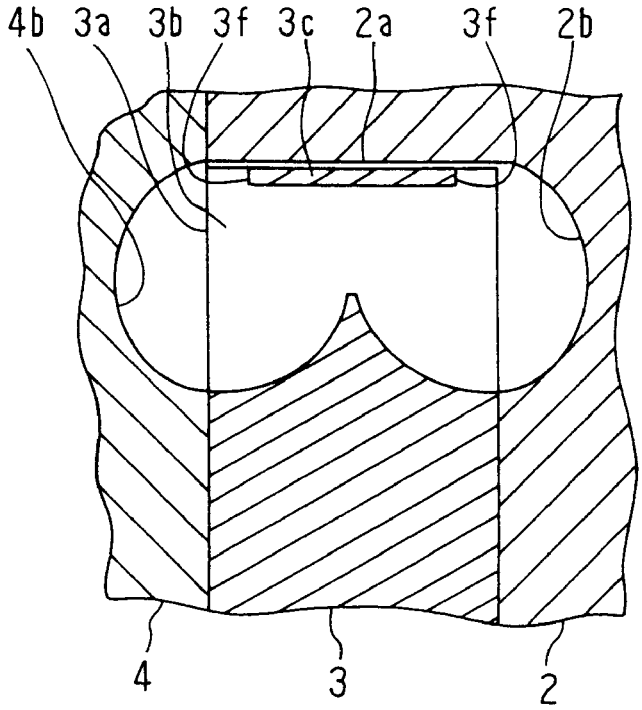
FIG. 5 is a fragmentary cross-sectional view of an impeller of a turbine pump according to a second embodiment of the invention.

A turbine pump according to a second embodiment of the invention is described with reference to FIG. 5. In the meantime, the same reference numeral represents the same or substantially the same portion, part or components as the first embodiment hereafter.

The outer ring 3*c* is positioned so that the axial ends thereof are located within the axial ends of the impeller 3. However, the axial end surfaces 3*f* of the outer ring 3*c* are not tapered off but are parallel to the axial end surfaces of the impeller.

Figure 6:
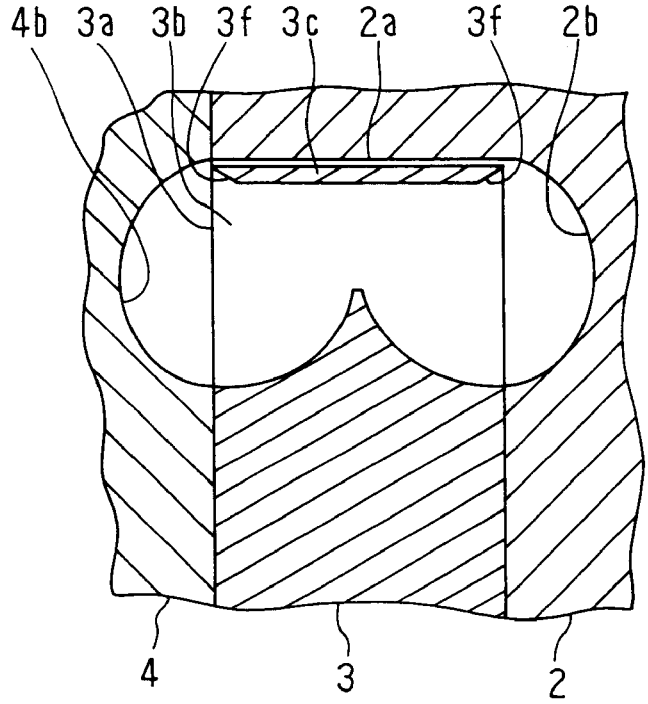
FIG. 6 is a fragmentary cross-sectional view of an impeller of a turbine pump according to a third embodiment of the invention.

A turbine pump according to a third embodiment of the invention is described with reference to FIG. 6.

The outer ring 3*c* has axial end surfaces 3*f* that taper off in the radially inward direction. However, the outer ring 3*c* has the same axial length as the impeller 3 and is positioned so that the axial ends thereof are located to be flush the axial ends of the impeller 3.

Figure 7:
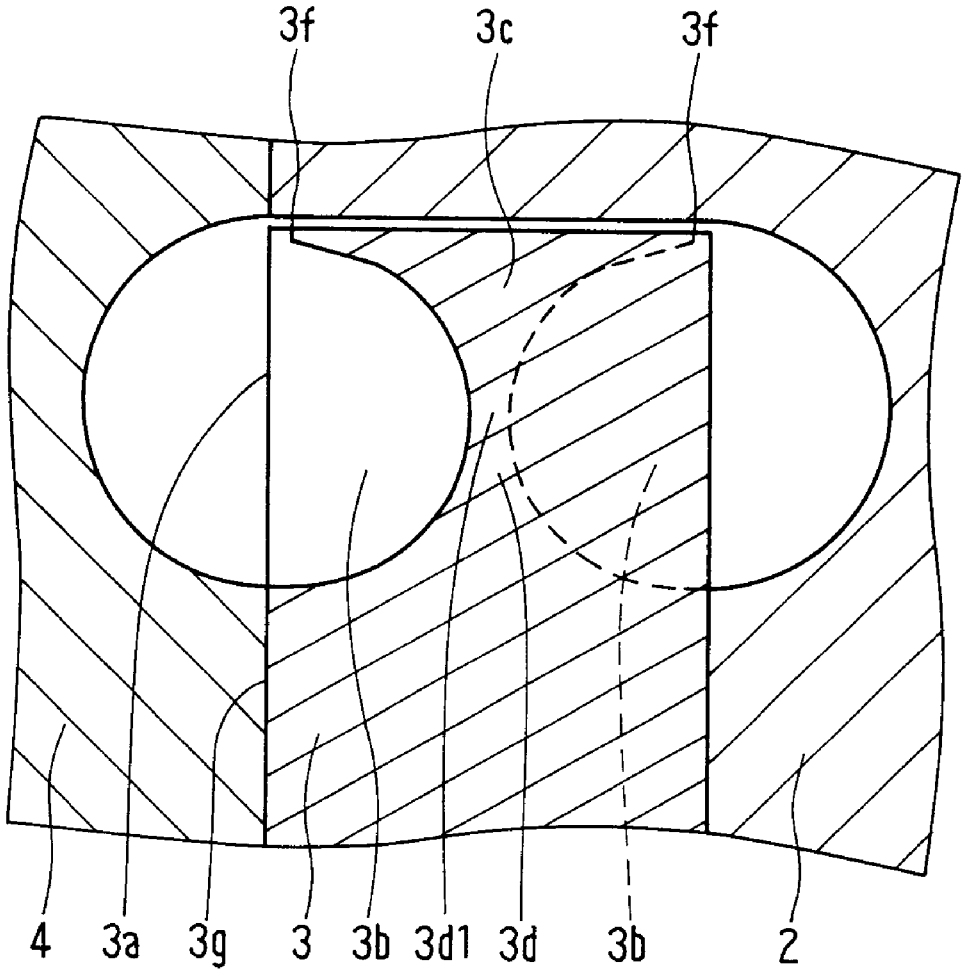
FIG. 7 is a fragmentary cross-sectional view of an impeller of a turbine pump according to a fourth embodiment of the invention.

A turbine pump according to a fourth embodiment of the invention is described with reference to FIG. 7.

The outer ring 3*c* and the impeller grooves 3*b* are formed by a circular or cylindrical surface to be continuous so that the axial ends of the outer ring 3*c* can be positioned outside the axially innermost portion 3*dl* of the impeller partitions 3*d*. The impeller grooves 3*b* are alternately formed on the front and rear surfaces of the impeller in the circumferential direction. Therefore, there is no space or opening between the outer ring 3*c* and the impeller partitions 3*d*. Because the outer ring 3*c* and the impeller partitions 3*d* formed by a cylindrical surface to be continuous, the fuel can circulate more smoothly.

In this embodiment, the axial end of the outer ring 3*c* can be tapered as the outer ring 3*c* shown in FIG. 2.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A turbine pump comprising:

a casing having an inlet, an outlet and front and rear arc-shaped pump passages;

an impeller disposed in said casing, said impeller having a plurality of blades disposed in the circumferential direction thereof, a plurality of impeller partitions respectively disposed between every two of said blades thereby forming a plurality of impeller grooves at front and rear sides of said partitions and an outer ring disposed at a peripheral edge of said blades and radially more outside than an axially innermost portion of said impeller grooves to connect said blades all together; wherein each of said impeller grooves, each of said pump passages and said outer ring form a space for circulating fuel pumped up from said inlet thereby pressuring and discharging said fuel from said outlet;

wherein the outside diameter of said impeller is smaller than the outside diameter of said pump passages so that peripheral portion of said impeller is disposed within said pump passages; and wherein said outer ring has a trapezoidal cross section with a shorter side thereof being radially inward.

2. The turbine pump as claimed in claim 1, wherein axial ends of said outer ring are positioned within axial ends of said plurality of blades.

3. A turbine pump comprising:

a pump cover having a fuel inlet, an arc-shaped front pump passage;

a pump casing having a fuel outlet and an arc-shaped rear pump passage; and an impeller disposed between said pump cover and said pump casing, said impeller having a plurality of blades disposed in the circumferential direction thereof, a plurality of impeller grooves between each two of said blades and an outer ring disposed at a peripheral edge of said blades for closing circumference of said blades, thereby forming circular spaces together with said impeller grooves, said pump passages for circulating fuel pumped up from said inlet thereby pressuring and discharging said fuel from said outlet;

wherein the outside diameter of said impeller is smaller than the outside diameter of said pump passages so that peripheral portions of said impeller is located within said front and rear pump passages and wherein said outer ring has a trapezoidal cross section with a shorter side thereof being radially inward.

4. A turbine pump comprising:

a pump cover having a fuel inlet, an arc-shaped front pump passage, said front pump passage has an outside diameter (D2);

a pump casing having a cylindrical space and a fuel outlet and an arc-shaped rear pump passage, said rear pump passage having the same outside diameter as said front passage and the inside diameter of said cylindrical space; and an impeller disposed within said cylindrical space between said pump cover and said pump casing, said impeller having a plurality of blades disposed in the circumferential direction thereof, a plurality of impeller grooves between each two of said blades and an outer ring disposed at a peripheral edge of said blades for closing circumference of said blades, thereby forming circular spaces together with said impeller grooves, said pump passages for circulating fuel pumped up from said inlet thereby pressuring and discharging said fuel from said outlet;

wherein the outside diameter (D1) of said impeller is smaller than the outside diameter (D2) of said front and rear pump passages so that peripheral portions of said impeller is located within said front and rear pump and wherein said outer ring has a trapezoidal cross section with a shorter side thereof being radially inward.

5. A turbine pump comprising:

a casing having a fuel inlet, a fuel outlet, a cylindrical space, an arc-shaped front pump passage, and an arc-shaped rear pump passage, said front and rear pump passage having an outside diameter; and an impeller disposed within said cylindrical space between said front pump passage and rear pump passage, said impeller having a plurality of blades disposed in the circumferential direction thereof, a plurality of impeller grooves between each two of said blades and an outer ring disposed at a peripheral edge of said blades for closing circumference of said blades, thereby forming circular spaces together with said impeller grooves, said pump passages for circulating fuel pumped up from said inlet thereby pressuring and discharging said fuel from said outlet;

wherein said impeller has a smaller outside diameter then the outside diameter of said front and rear pump passages so that peripheral portions of said impeller is located opposite said front and rear pump and wherein said outer ring has a trapezoidal cross section with a shorter side thereof being radially inward.

6. The turbine pump as claimed in claim 5, wherein axial ends of said outer ring are positioned within axial ends of said plurality of blades.

* * * * *